US011857033B2

(12) United States Patent
Botkus et al.

(10) Patent No.: US 11,857,033 B2
(45) Date of Patent: Jan. 2, 2024

(54) MAGNETO-MECHANICAL CLOSURE DEVICE FOR FASTENING TO AN ASSOCIATED ASSEMBLY

(71) Applicant: Fidlock GmbH, Hannover (DE)

(72) Inventors: Breido Botkus, Hannover (DE); Oliver Schaub, Hannover (DE); Björn Bleckat, Hannover (DE); Philip Klein, Hannover (DE)

(73) Assignee: Fidlock GmbH, Hannover (DE)

( * ) Notice: Subject to any disclaimer, the term of this patent is extended or adjusted under 35 U.S.C. 154(b) by 0 days.

(21) Appl. No.: 17/877,044

(22) Filed: Jul. 29, 2022

(65) Prior Publication Data

US 2023/0033255 A1 Feb. 2, 2023

(30) Foreign Application Priority Data

Jul. 30, 2021 (DE) ..... 10 2021 208 311.0

(51) Int. Cl.
*A44B 11/20* (2006.01)
*A45C 13/10* (2006.01)

(52) U.S. Cl.
CPC ..... *A44B 11/20* (2013.01); *A45C 13/1069* (2013.01); *A44D 2203/00* (2013.01)

(58) Field of Classification Search
CPC ... A44B 11/20; A44B 11/005; A44B 11/2588; A44D 2203/00; A45C 13/1069; A43C 11/142; A43C 11/165; A41F 1/002
See application file for complete search history.

(56) References Cited

U.S. PATENT DOCUMENTS

| | | | | |
|---|---|---|---|---|
| 10,179,548 | B2 * | 1/2019 | Fiedler | F16B 21/02 |
| 10,342,294 | B2 * | 7/2019 | Lovett | A43C 15/00 |
| 10,543,630 | B2 * | 1/2020 | Hipwood | B29C 45/14311 |
| 10,772,384 | B2 * | 9/2020 | Whewell | A43B 1/0081 |
| 10,842,230 | B2 * | 11/2020 | Pollack | A43C 11/20 |
| 11,525,470 | B2 * | 12/2022 | Richter | F16B 7/20 |
| 2010/0283269 | A1 | 11/2010 | Fiedler | |
| 2010/0308605 | A1 | 12/2010 | Fiedler | |
| 2015/0135486 | A1 | 5/2015 | Fiedler et al. | |

(Continued)

FOREIGN PATENT DOCUMENTS

| | | | |
|---|---|---|---|
| DE | 102015216242 | A1 | 3/2017 |
| EP | 2040572 | B1 | 12/2012 |

(Continued)

*Primary Examiner* — Robert Sandy
*Assistant Examiner* — Louis A Mercado
(74) *Attorney, Agent, or Firm* — THE WEBB LAW FIRM

(57) ABSTRACT

A closure device for connecting two assemblies to each other includes a first closure part, which is associated to a first one of the assemblies and includes a first magnetic element, and a second closure part which includes a second magnetic element. The first closure part and the second closure part can be attached to each other along a closing direction by magnetic attraction between the first magnetic element and the second magnetic element, are mechanically and/or magnetically held at each other in a closed position, and can be separated from each other for opening the closure device. A connecting part includes a fastening device for fastening the second closure part to the connecting part and an integration portion for fixing the connecting part to a second one of the assemblies.

9 Claims, 12 Drawing Sheets

(56) References Cited

U.S. PATENT DOCUMENTS

| | | | | |
|---|---|---|---|---|
| 2016/0073744 | A1 | 3/2016 | Fiedler et al. | |
| 2017/0057420 | A1 | 3/2017 | Fiedler et al. | |
| 2020/0069002 | A1 | 3/2020 | Fiedler et al. | |
| 2020/0245711 | A1* | 8/2020 | Trudel | A43C 11/165 |
| 2020/0268108 | A1 | 8/2020 | Fiedler | |
| 2020/0390196 | A1* | 12/2020 | Manzato | A43C 11/14 |
| 2021/0196000 | A1* | 7/2021 | Trudel | A43C 11/165 |

FOREIGN PATENT DOCUMENTS

| | | | |
|---|---|---|---|
| EP | 2252176 | B1 | 4/2015 |
| EP | 2833754 | B1 | 4/2016 |
| EP | 2825075 | B1 | 6/2016 |
| WO | 2018158336 | A1 | 9/2018 |
| WO | 2019096447 | A1 | 5/2019 |

* cited by examiner (A – A)

MAGNETO-MECHANICAL CLOSURE DEVICE FOR FASTENING TO AN ASSOCIATED ASSEMBLY

CROSS-REFERENCE TO RELATED APPLICATION

This application claims priority to German Patent Application No. 10 2021 208 311.0 filed Jul. 30, 2021, the disclosure of which is hereby incorporated by reference in its entirety.

BACKGROUND OF THE INVENTION

Field of the Invention

This invention relates to a closure device for connecting two assemblies to each other as described herein.

Description of Related Art

Such a closure device comprises a first closure part, which is associated to a first one of the assemblies and includes a first magnetic element, and a second closure part, which includes a second magnetic element. The first closure part and the second closure part can be attached to each other by magnetic attraction between the first magnetic element and the second magnetic element along a closing direction, are mechanically and/or magnetically held at each other in a closed position, and can be separated from each other for opening the closure device.

Such a closure device can be designed for example in the form of a magneto-mechanical closure, as it is described in EP 2 040 572 B1, EP 2 252 176 B1, EP 2 833 754 B1, EP 2 825 075 B1, WO 2019/096447 A1 or WO 2018/158336 A1.

Via such a closure device, two assemblies generally can be connected to each other. The attachment is effected with magnetic support by the magnetic elements, in that the closure parts are magnetically drawn towards each other during the attachment. In the closed position, the closure parts are connected to each other and thus held at each other due to the force of magnetic attraction and preferably in addition by mechanical latching. To open the closure device, the closure parts can be separated from each other so that in this way the assemblies can be released from each other.

The closure parts generally are formed as rigid parts. For example, the second assembly on the other hand can be a flexible, for example textile part. It here is desirable that the second closure part can be flexibly, easily and inexpensively connected to the associated, second assembly.

SUMMARY OF THE INVENTION

It is an object of the present invention to provide a closure device which provides for a flexible, easy and inexpensive connection of at least one of the closure parts to an associated assembly.

This object is achieved by a subject-matter with the features as described herein.

Accordingly, the closure device includes a connecting part which includes a fastening device for fastening the second closure part to the connecting part and an integration portion for fixing the connecting part to a second one of the assemblies.

The connecting part is configured as an additional part with respect to the first and second closure parts. The connecting part serves to produce a connection of the second closure part to the associated second assembly, in that the connecting part is fixed to the second assembly and via the fastening device provided on the connecting part creates an attachment for the second closure part.

Thus, the connecting part serves for integration of the closure device into the second one of the assemblies. The integration portion of the connecting part therefor can be configured for example as a flat portion which can be attached to the second one of the assemblies and can be connected to the second one of the assemblies. The integration portion in particular can be firmly and non-releasably (i.e. not releasable without being destructed) connected to the second one of the assemblies. For example, the integration portion can be designed to connect the connecting part to the second one of the assemblies by sewing, welding or gluing.

Via the fastening device, the second closure part in the fastened position is firmly and loadably connected to the connecting part and thus to the associated, second assembly. The fastening device can be designed such that the second closure part is non-releasably connected to the connecting part. In another embodiment, the locking device can be designed such that the second closure part can again be released from the connecting part.

For example, the fastening device can be designed such that the second closure part can be released from the connecting part on exceedance of a load force. This can provide for emergency opening by releasing the connection between the second closure part and the connecting part under an excessive load.

By providing the connecting part, the integration of the closure device into the second one of the assemblies can be decoupled from the second closure part. For integration of the closure device, the connecting part is connected, for example sewn, welded or glued, to the associated, second assembly. Due to the fact that the second closure part can be connected to the fastening device of the connecting part, the second closure part is fixed to the associated, second assembly. The connecting part here can be designed as a simple, inexpensive component and can be adapted in its material in particular to the second assembly, for example in that the integration portion is so flexible and deformable that it can be adapted to the shape of the second assembly in a simple way and can be connected, for example sewn, welded or glued, to the second assembly.

The second closure part in particular can be connectable to the connecting part, while the connecting part is already fixed to the second assembly via the integration portion. This provides for initially mounting the connecting part on the second assembly and then for fixing the second closure part to the connecting part, so as to connect the second closure part to the associated, second assembly.

The second assembly for example can be a textile component, such as a shoe or a garment. Due to the fact that via the connecting part an intermediate piece is created between the second closure part and the second assembly, the second assembly can be fabricated and be connected to the connecting part without the second closure part already being connected to the connecting part. This avoids an action on the second closure part during the manufacture of the second assembly, for example an action of heat on the second magnetic element of the second closure part.

The connecting part can be fabricated as an inexpensive component, for example from plastic material. The connecting part here can be designed with a flat construction, which provides for a fabrication of the second assembly, for example in the form of a textile component, in a flat design.

When the second closure part can again be released from the connecting part, recycling becomes easily possible in that the second closure part is released from the associated assembly and thus the second closure part or at least parts thereof, for example the second magnetic element, can be reused. In addition, maintenance, renewal or repair can be effected by replacement or restoration of the second closure part.

The connecting part can be fabricated as an identical part and can be usable with entirely different closure devices, which can further contribute to a cost-effective manufacture.

The connecting part can also entirely be configured as part of the associated assembly, for example as a housing part, in which the fastening device is realized.

The connecting part can be designed as a moisture-tight component and be sealingly connected to the associated, second assembly.

The integration portion can be of flat design and for example be flexibly deformable. The integration portion is connected to the second assembly when the connecting part is fixed to the second assembly, and for example can flexibly adapt to the shape of the second assembly.

In one embodiment, the connecting part can perform a further function of the superordinate assembly. For example, the connecting part can include one or more eyelets for example for mounting a traction means, for example in the form of a strap or a rope, of the superordinate assembly. In another embodiment, the connecting part can include one or more guides, for example longitudinal guides, for guiding a component of the superordinate assembly.

In one embodiment, the fastening device is configured for producing a positive and/or non-positive connection with the second closure part. For fastening purposes, the second closure part can be attached to the fastening device of the connecting part and is held on the fastening device in the fastened position so that the second closure part thereby is connected to the associated, second assembly.

For example, the fastening device in one embodiment can include at least one form-fit element for producing a positive connection. For example two form-fit elements can be present, between which the second closure part can be inserted so as to create a positive connection between the second closure part and the connecting part.

In one embodiment, the second closure part can be connected to the at least one form-fit element along a fastening direction. When two form-fit elements are present, the second closure part can be pushed for example between the two form-fit elements along the fastening direction, so as to positively fix the second closure part to the form-fit elements.

Here, it can be provided that the second closure part is fixed in the fastened position along the fastening direction by at least one latching element. For example, the second closure part can be connected to one or more form-fit elements along the fastening direction such that in the fastened position the second closure part abuts against a stop element and thus is in a defined position relative to the one or more form-fit elements. In this defined, fastened position the second closure part is latchingly fixed by one or more latching elements so that the second closure part cannot be released from the one or more form-fit elements against the fastening direction, at least not without releasing the latching of the at least one latching element.

In another embodiment, the fastening device is configured for producing a bayonet connection with the second closure part. For this purpose, the fastening device for example can have an opening in which the second closure part can be inserted in order to fasten the second closure part to the connecting part. The opening can be designed for example as a circular opening, wherein the second closure part can be rotated in the opening about an axis of rotation central (perpendicular) to the circular opening for producing the bayonet connection. In the first rotary position, the second closure part can be attached to the connecting part. By rotating from the first rotary position into a second rotary position, the bayonet connection is produced and the second closure part thus is fixed to the connecting part.

For example, the fastening device can include at least one engagement element protruding into the opening in order to produce the bayonet connection with the second closure part. For example, an arrangement of a plurality of engagement elements on the connecting part can be protrude into the opening. On insertion of the second closure part into the opening, the engagement elements come into engagement with the second closure part, wherein the bayonet connection is produced by rotating the second closure part in the opening, and the second closure part thus is fastened to the connecting part.

In one embodiment, the fastening device has a shell surface extended around the opening, in particular a cylindrical shell surface, on which the at least one engagement element is arranged. The second closure part is attached to the shell surface in order to produce the connection with the connecting part.

In one embodiment, the second closure part has at least one engagement opening into which the at least one engagement element engages with the bayonet connection made. The engagement opening for example can be molded to a cylindrical body of the closure part and form a fitting portion into which the at least one engagement element is introduced when the second closure part is attached to the connecting part. The fitting portion is adjoined by a locking portion into which the at least one engagement element is pushed when the second closure part is rotated relative to the connecting part about the axis of rotation, so that in this way the bayonet connection between the second closure part and the connecting part is produced.

In one embodiment, the second closure part has a body and a receiving opening arranged in the body for receiving the second magnetic element. In the receiving opening, the magnetic element of the second closure part is arranged, wherein the receiving opening for example is closed towards the outside by the connecting part when the second closure part is fastened to the connecting part. The connecting part (preferably moisture-tight for this purpose) thus encapsulates the second magnetic element in the body of the second closure part. While the receiving opening is open towards the outside before the second closure part is connected to the connecting part, the receiving opening is closed by connecting the second closure part to the connecting part, so that the magnetic element is received in the body in an encapsulated, preferably moisture-tight way.

The closure device for example can be configured in the form of a magneto-mechanical closure, as it is described in EP 2 040 572 B1, EP 2 252 176 B1, EP 2 833 754 B1, EP 2 825 075 B1, WO 2019/096447 A1 or WO 2018/158336 A1.

The closure device for example can form a winding portion on the first closure part for winding up a traction element (in this case forming the first assembly), for example a traction cable, for instance a shoelace. For example, the first closure part can include a first toothing portion and the second closure part can include a second toothing portion. In the closed position, in which the first closure part and the second closure part are connected to each other, the toothing portions are in meshing engagement with each other, wherein for example a rotation of the first closure part relative to the second closure part is possible in a winding direction in order to wind the traction element onto the winding portion of the first closure part, but an opposite rotation against the winding direction is blocked due to the meshing engagement, so that the traction element cannot be unwound against the winding direction when the first closure part and the second closure part are connected to each other in the closed position.

In another embodiment, the first closure part can include a rigid first engagement element and the second closure part can include a rigid second engagement element, which in the closed position are in positive engagement with each other. On the first closure part, for example a force introduction element movable, for example pivotable relative to the first engagement element, for example in the form of a bracket for connecting a belt, can be arranged, which is coupled to the rigid engagement element of the first closure part at a force introduction point. The force introduction point can be located in the region of a front end of the first engagement element, which in the closed position faces the rigid second engagement element of the second closure part.

In again another embodiment, the first closure part can include an arresting element in the form of a rigid pin which can lockingly be brought in engagement with a spring locking element of the second closure part. Connecting the closure parts here can be effected by attaching the first closure part to the second closure part in the closing direction, while opening the closure device is effected by moving the closure parts along an opening direction different from the closing direction. The opening direction for example can be directed transversely to the closing direction. The spring locking element for example can have the shape of a C-ring which in the closed position encloses the pin-shaped arresting element of the first closure part and thereby produces an interlock between the closure parts. For opening, the arresting element can be pushed out of the area of the spring locking element in the opening direction, so as to eliminate the interlock.

In one embodiment, an arrangement comprises a closure device as described above, wherein the first closure part is sewn, welded or glued to a first assembly of the arrangement and the integration portion of the connecting part is sewn, welded or glued to a second assembly of the arrangement. The arrangement for example can partly or completely be a textile arrangement, for instance a shoe, a garment, a bag, a backpack or a suitcase. Via the integration portion, the second closure part in particular can be fastened to a textile portion of the arrangement.

According to another aspect, a closure device for connecting two assemblies to each other comprises a first closure part, which is associated to a first one of the assemblies and includes a first magnetic element, and a second closure part which is associated to a second one of the assemblies and includes a second magnetic element. The first closure part and the second closure part can be attached to each other along a closing direction by magnetic attraction between the first magnetic element and the second magnetic element, are mechanically and/or magnetically held at each other in a closed position, and can be separated from each other for opening the closure device. The closure device additionally includes a fastening device for fastening the second closure part to the second one of the assemblies. The fastening device is configured to produce a bayonet connection with the second closure part.

In the closure device, the second closure part thus is to be fixed to the second assembly. This is effected via a fastening device in the form of a bayonet lock by means of which the second closure part can be fastened to the second assembly, for example to a housing part of the second assembly.

In this embodiment, the second closure part thus is directly fixed to the second assembly via the bayonet connection. The fastening device therefor can be part of the second assembly and be integrated into the second assembly, for example into a housing part of the second assembly.

To produce the bayonet connection, the fastening device for example can have an opening on the second one of the assemblies, into which the second closure part can be inserted in order to fasten the second closure part to the second one of the assemblies. The opening can be designed for example as a circular opening, wherein the second closure part can be rotated in the opening about an axis of rotation central (perpendicular) to the circular opening in order to produce the bayonet connection. In a first rotary position, the second closure part can be attached to the second one of the assemblies. By rotating from the first rotary position into a second rotary position, the bayonet connection is produced and the second closure part thus is fixed to the second one of the assemblies.

For example, the fastening device can include at least one engagement element protruding into the opening in order to produce the bayonet connection with the second closure part. For example, an arrangement of a plurality of engagement elements can protrude into the opening. On insertion of the second closure part into the opening, the engagement elements come into engagement with the second closure part, wherein by rotating the second closure part in the opening, the bayonet connection is produced and the second closure part thus is fastened to the second one of the assemblies.

In one embodiment, the fastening device has a shell surface extended around the opening, in particular a cylindrical shell surface, on which the at least one engagement element is arranged. The second closure part is attached to the shell surface in order to produce the connection with the second one of the assemblies.

In one embodiment, the second closure part has at least one engagement opening into which the at least one engagement element engages with the bayonet connection made. The engagement opening for example can be molded to a cylindrical body of the closure part and form a fitting portion into which the at least one engagement element is introduced when the second closure part is attached to the connecting part. The fitting portion is adjoined by a locking portion into which the at least one engagement element is pushed when the second closure part is rotated relative to the fastening device about the axis of rotation, so that in this way the bayonet connection between the second closure part and the second one of the assemblies is produced.

BRIEF DESCRIPTION OF THE DRAWINGS

The idea underlying the invention will be explained in detail below with reference to the exemplary embodiments illustrated in the Figures, in which.

DESCRIPTION OF THE INVENTION

Figure 1:
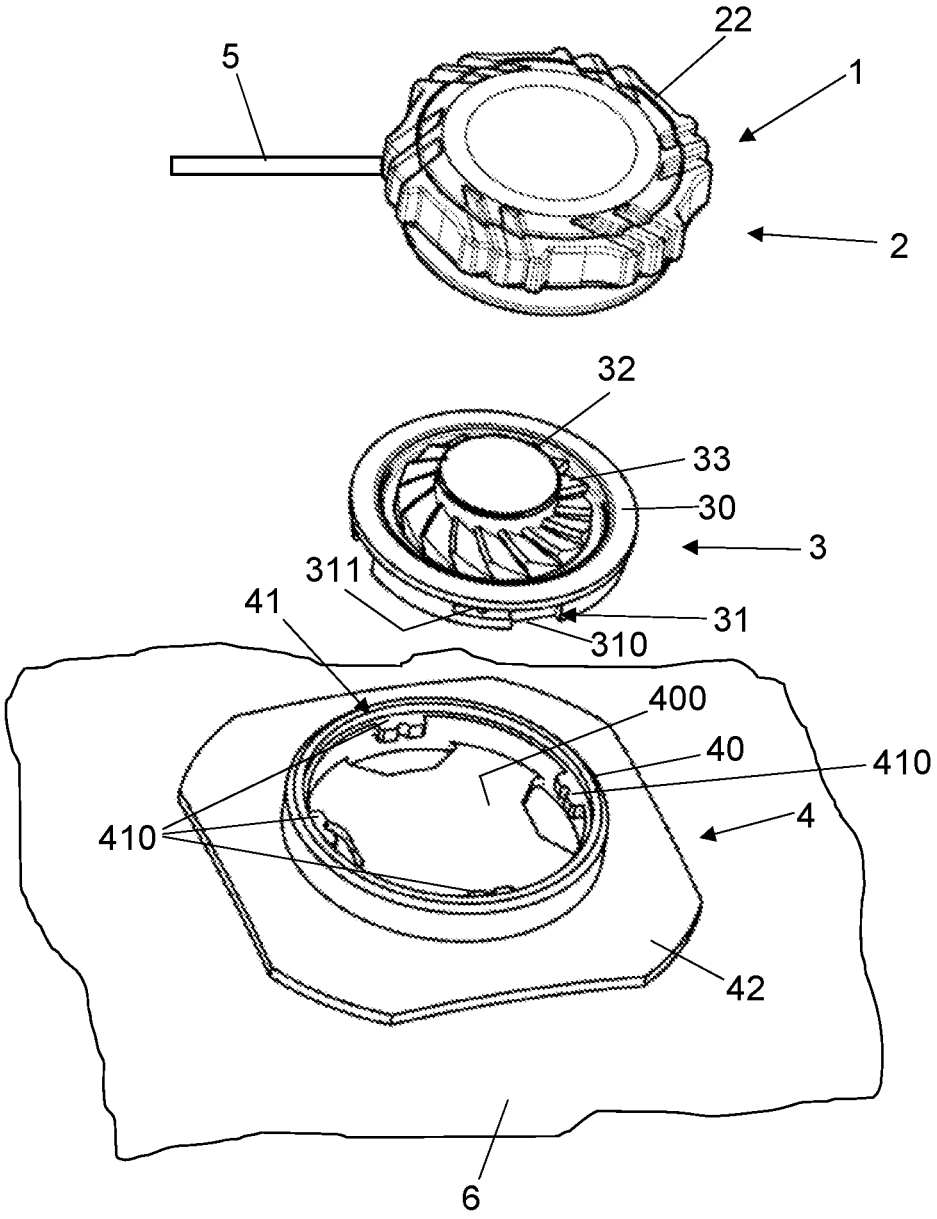
FIG. 1 shows a view of a first exemplary embodiment of a closure device, in a position in which a second closure part is separated from an associated connecting part.
Figure 2:
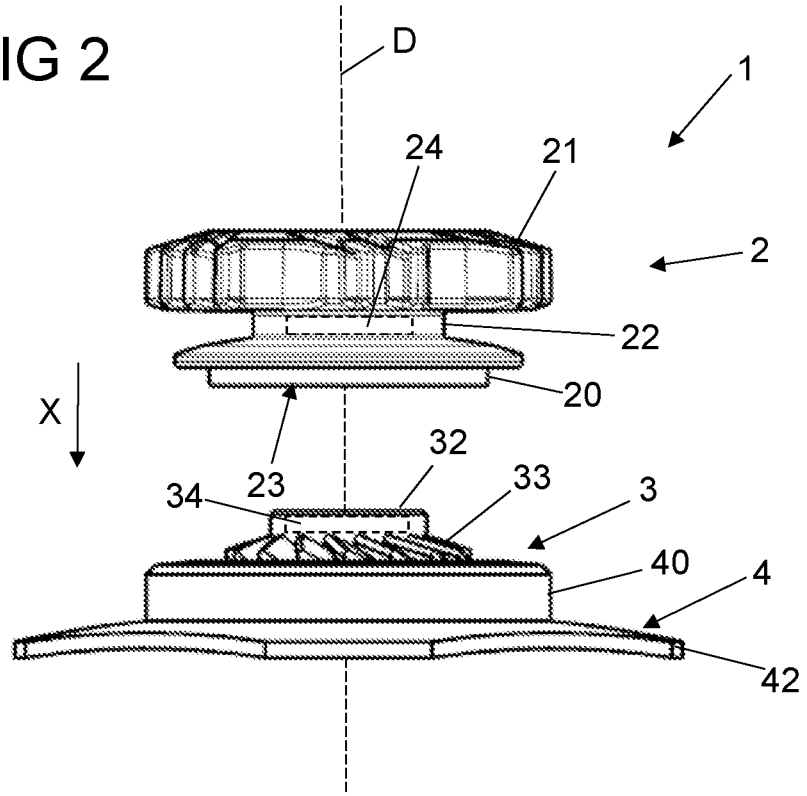
FIG. 2 shows a view of the closure device before attachment of a first closure part to the second closure part.

FIGS. 1 to 5A-5C show a first exemplary embodiment of a closure device 1 which includes a first closure part 2, a second closure part 3 and a connecting part 4. The first closure part 2 is associated to a first assembly 5, in the illustrated exemplary embodiment for example a traction element in the form of a strap or rope for example of a garment or a shoe. The second closure part 3 on the other hand is associated to a second assembly 6, for example to a textile portion, for example of a garment or a shoe, wherein in the operational position the second closure part 3 is fixed to the second assembly 6 via the connecting part 4.

The closure device 1 is designed as a magneto-mechanical closure device. In the operational position, the second closure part 3 is fixed to the connecting part 4, as can be taken from FIGS. 2 and 3. The first closure part 2 can be attached to the second closure part 3 along a closing direction X and thus can be connected to the second closure part 3, wherein the first closure part 2 and the second closure part 3 each include a magnetic element 24, 34, which on attachment of the closure parts 2, 3 to each other face each other in a magnetically attracting manner and thus magnetically support the attachment.

Figure 3:
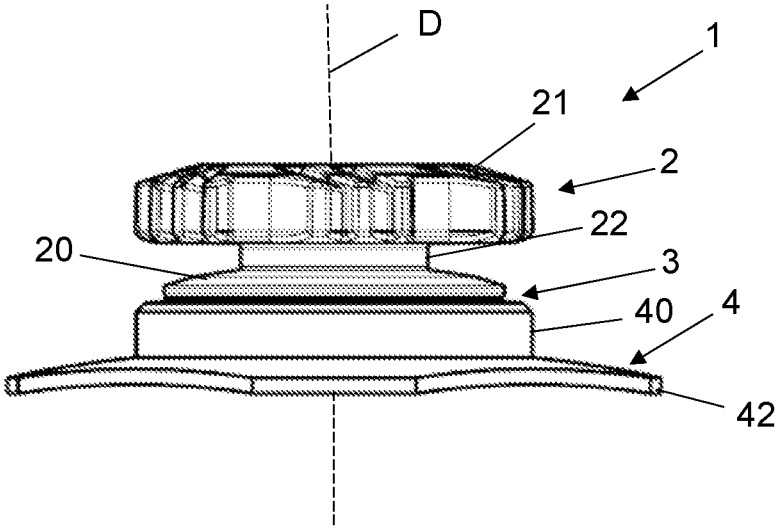
FIG. 3 shows a view of the closure device in a closed position.

In the closed position, shown in FIG. 3, the closure parts 2, 3 are held at each other due to the magnetic attraction between the magnetic elements 24, 34.

As can be taken from FIGS. 2, 3 and 4A, 4B, the first closure part 2 has a body 20 which on a side facing the second closure part 3 forms a toothing portion 23 in the form of a conical internal toothing. A winding portion 22 in the form of a winding groove is molded to the body 20, on which the traction element 5, for example in the form of a traction cable, can be wound and from which the traction element 5 can also be unwound again. On the body 20, a handle element 21 is firmly arranged, via which a user can grasp the first closure part 2 in order to produce or again release the connection between the closure parts 2, 3 or in order to rotate the first closure part 2 relative to the second closure part 3.

The second closure part 3 has a body 20 to which a toothing portion 33 is molded on a side facing the first closure part 2, which circumferentially surrounds a pin portion 32. Within the pin portion 32, the magnetic element 34 associated to the second closure part 3 is received in a receiving opening 301.

In the closed position of the closure device 1, the toothing portions 23, 33 of the closure parts 2, 3 are in meshing engagement with each other, and the pin portion 32 of the second closure part 3 engages into the first closure part 2 for rotational support. The toothing portions 23, 33 here, in the illustrated exemplary embodiment, are shaped such that the first closure part 2 can be rotated in a winding direction relative to the second closure part 3 while the toothing portions 23, 33 slide over each other, for example in order to wind the traction element 5 onto the winding portion 22 of the first closure part 2. A reverse rotation, however, is blocked by the meshing engagement so that the traction element 5 can be tensioned, but cannot easily be released, in any case not without separating the closure parts 2, 3 from each other.

For opening the closure device 1, the first closure part 2 can be removed from the second closure part 3 against the closing direction X, against the force of magnetic attraction between the magnetic elements 24, 34.

In the illustrated exemplary embodiment, the second closure part 3 is fixed to the associated assembly 6 via the connecting part 4. The connecting part 4 here can be fabricated as a simple, inexpensive component, for example from plastic material, and in particular does not include any magnetic elements.

The connecting part 4 forms an integration portion 42 which extends in a planar manner and for example can be flexibly deformable. Via the integration portion 42, the connecting part 4 can be fixed to the assembly 6, for example by sewing, welding or gluing.

Figure 4A:
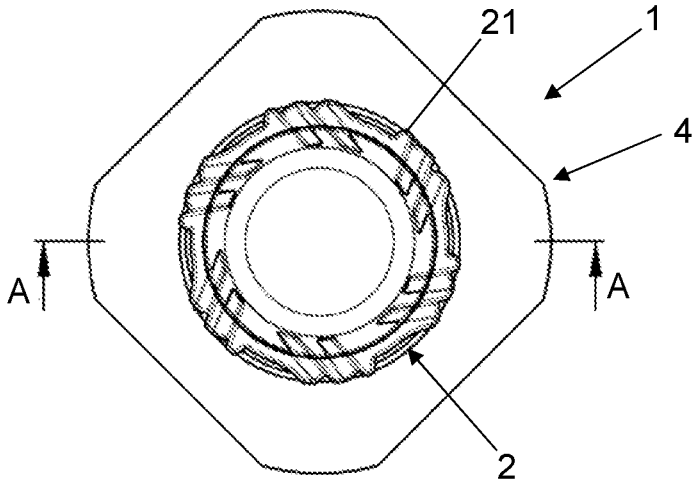
FIG. 4A shows a top view of the arrangement of FIG. 1.
Figure 4B:
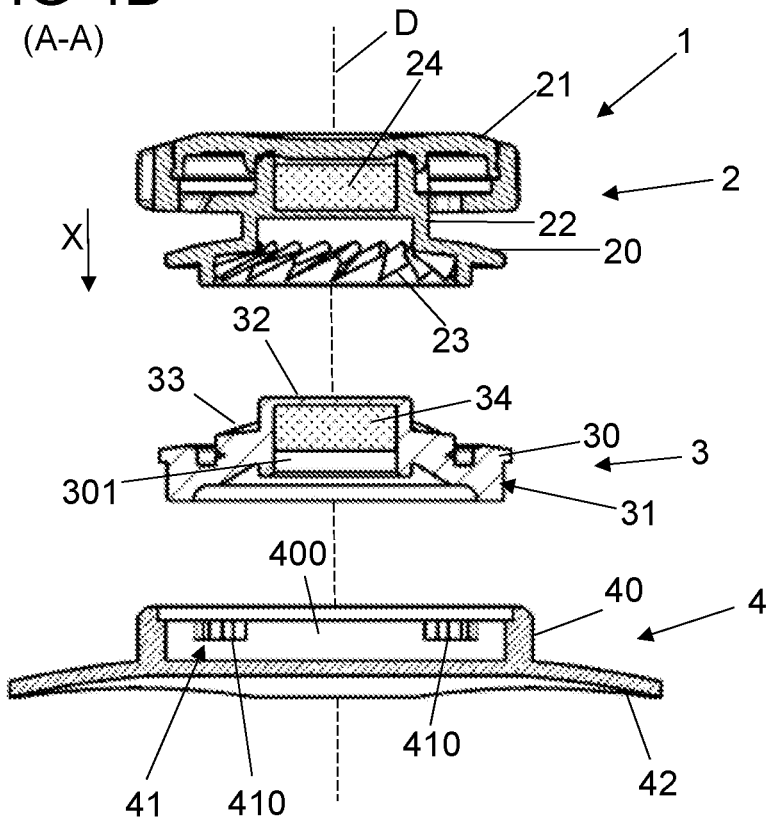
FIG. 4B shows a sectional view along line A-A of FIG. 4A.

As this can be taken from FIG. 1 in a synopsis with FIG. 4B, the connecting part 4 forms a cylindrical collar with a shell surface 40 molded thereto, which surrounds an opening 400. For fastening the second closure part 3 to the connecting part 4, the body 30 of the second closure part 3 can be inserted into the opening 400 so that a fastening device 41 within the collar interacts with the body 30 of the second closure part 3 and in this way creates an attachment between the second closure part 3 and the connecting part 4.

The fastening device 41 is formed by engagement elements 410 in the form of protrusions inwardly protruding into the opening 400. On attachment of the second closure part 3 to the connecting part 4, the engagement elements 410 come into engagement with engagement openings 31 on the body 30 of the second closure part 3 so that a connection between the second closure part 3 and the connecting part 4 thereby is made.

The engagement elements 410 and the engagement openings 31 are designed to produce a bayonet connection. On insertion of the second closure part 3 into the opening 400, the engagement elements 410 initially come into engagement with axially open fitting portions 310 of the engagement openings 31, as can be taken from FIG. 1 in a synopsis with FIG. 5B. When the engagement elements 410 have been inserted into the fitting portions 310, the second closure part 3 can be rotated relative to the connecting part 4 about an axis of rotation D in a fastening direction U so that the engagement elements 410 run into locking portions 311 of the engagement openings 31, which adjoin the fitting portions 310 in the fastening direction U, as can be taken from FIG. 1 in a synopsis with FIGS. 5B and 5C.

Figure 5A:
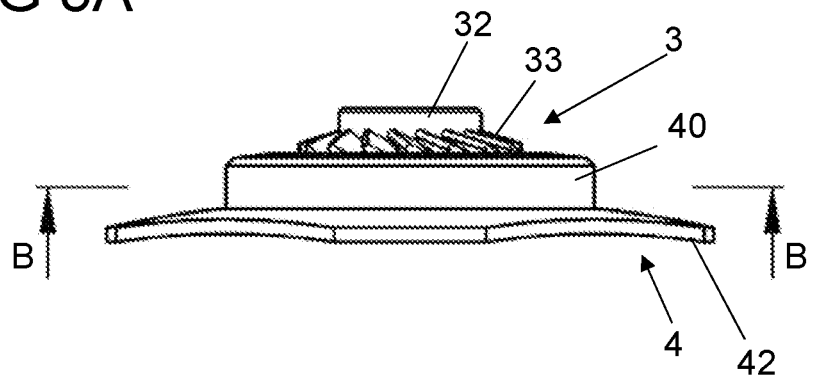
FIG. 5A shows a side view of the second closure part on the connecting part.
Figure 5B:
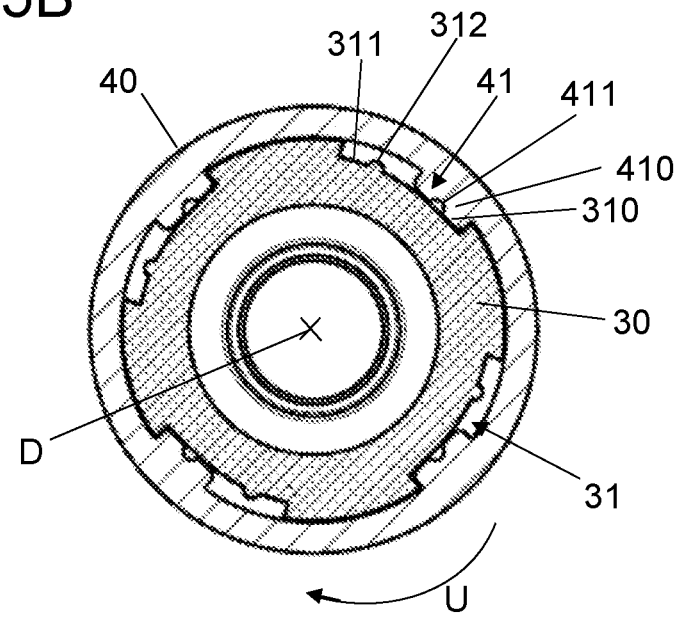
FIG. 5B shows a sectional view along line B-B of FIG. 5A, when making the connection of the second closure part with the connecting part.
Figure 5C:
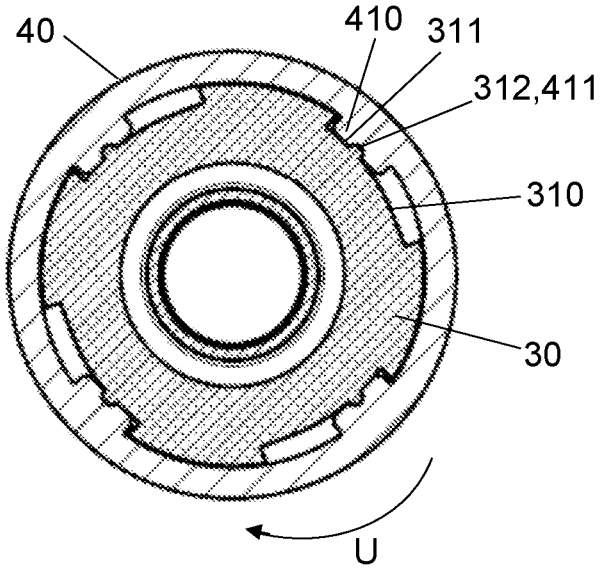
FIG. 5C shows the view of FIG. 5B, with the bayonet connection made.

FIG. 5C shows the locked position with the bayonet connection made, in which the engagement elements 410 rest in the locking portions 311 and thereby positively connect the second closure part 3 to the connecting part 4.

Within the locking portions 311 arresting elements 312 in the form of protruding latching noses are molded, which in the fastened position with the bayonet connection made are in engagement with associated arresting openings 411 on the engagement elements 410, as can be taken from FIG. 5C. Thus, in the fastened position with respect to the connecting part 4, the second closure part 3 is secured against being released.

In the illustrated exemplary embodiment, the second closure part 3 in the operational position is connected to the associated assembly 6, for example to a textile portion of a garment or the like, via the connecting part 4. The second closure part 3 can also be released again from the connecting part 4, in that the bayonet connection is eliminated by releasing the engagement elements 410 from the engagement openings 31. This for example allows a maintenance, renewal or repair of the closure device 1 by exchange or restoration of the second closure part 3. Moreover, this provides for simple recycling in that the second closure part 3 can easily be reused by being released from the connecting part 4.

FIGS. 6 to 13A, 13B show another exemplary embodiment of the closure device 1 which includes a first closure part 2, a second closure part 3 and a connecting part 4. Again, the second closure part 3 can be fastened to an associated assembly via the connecting part 4, wherein in the operational position the closure parts 2, 3 can be connected to each other so as to create a connection between assemblies associated to each other.

In the illustrated exemplary embodiment, the first closure part 2 has a body 20 in the form of a rigid element to which an engagement element 25 is molded at one end. A force introduction element 26 in the form of a bracket is pivotally articulated to the body 20 about a force introduction axis 260. An actuating element 27 in the form of a tab is arranged on the body 20 and can be actuated by a user to release the closure parts 2, 3 from each other by the user grasping the actuating element 27 and thereby pulling the closure parts 2, 3 away from each other.

Via the force introduction element 26, for example a connection of the first closure part 2 to an associated assembly in the form of a belt or the like can be produced.

The second closure part 3 has a body 30 to which a rigid engagement element 35 is molded, which forms an arresting portion 350 in the form of an undercut on a rigid portion 351. Transversely offset and parallel to the engagement element 35, a blocking element 36 is molded to the body 30.

Figure 9A:
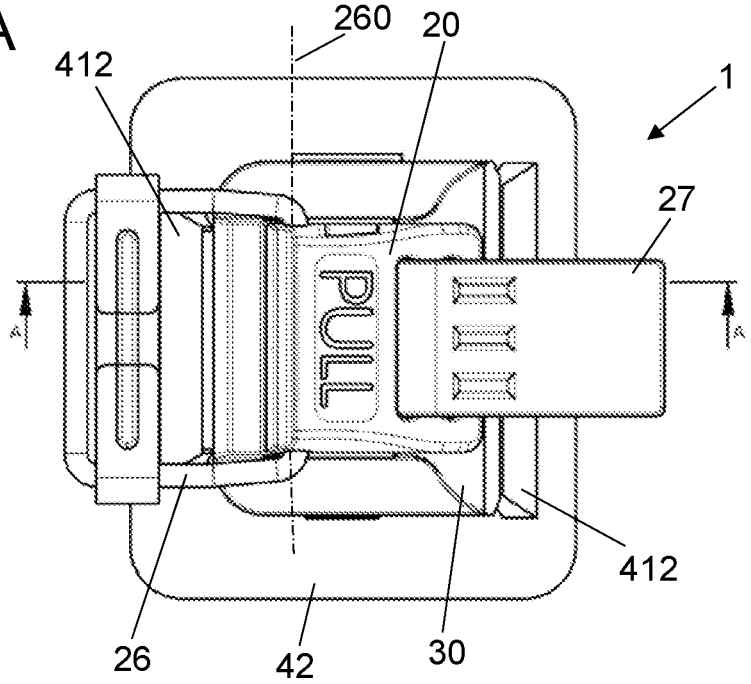
FIG. 9A shows a top view of the arrangement of FIG. 6.
Figure 9B:
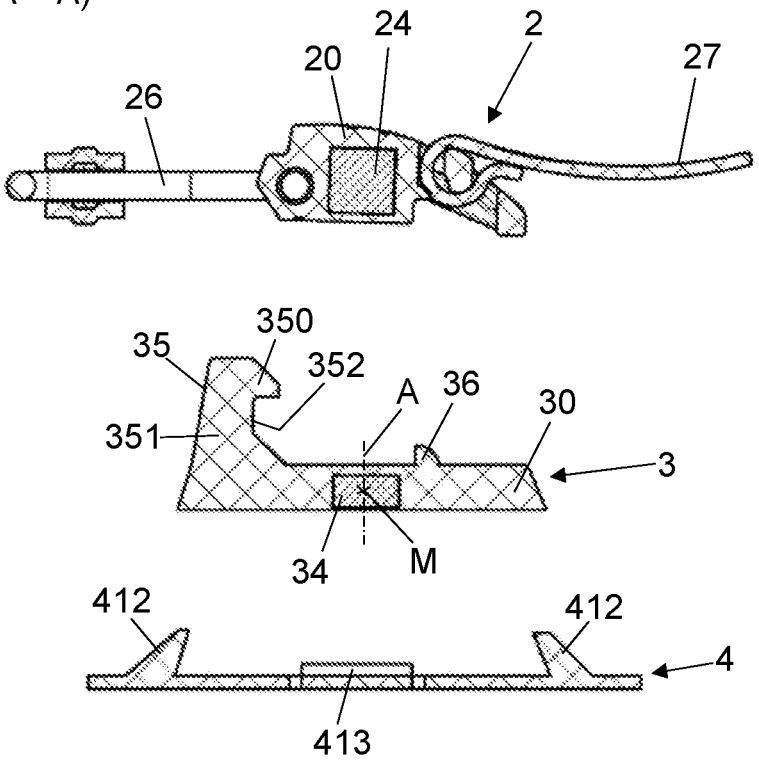
FIG. 9B shows a sectional view along line A-A of FIG. 9A.
Figure 10:
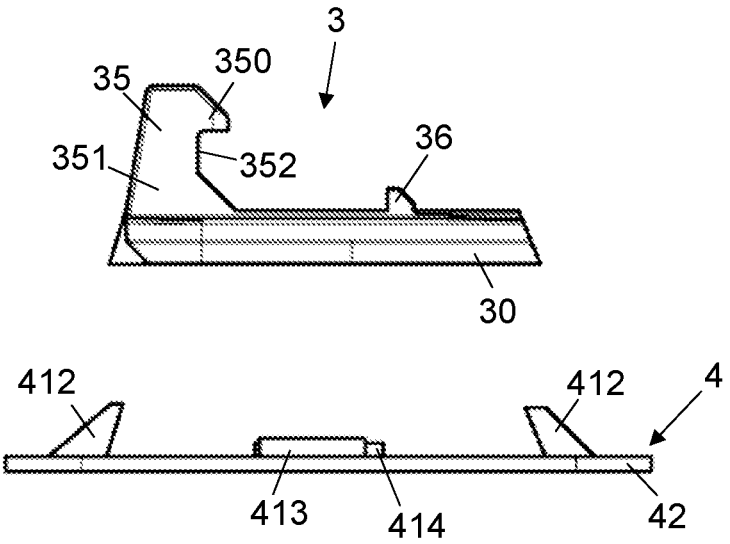
FIG. 10 shows a view of the second closure part before connection to an associated connecting part.
Figure 11:
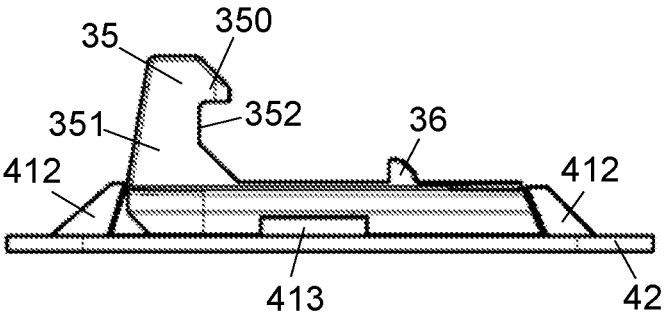
FIG. 11 shows a view in a position of the second closure part fastened to the connecting part.
Figure 12A:
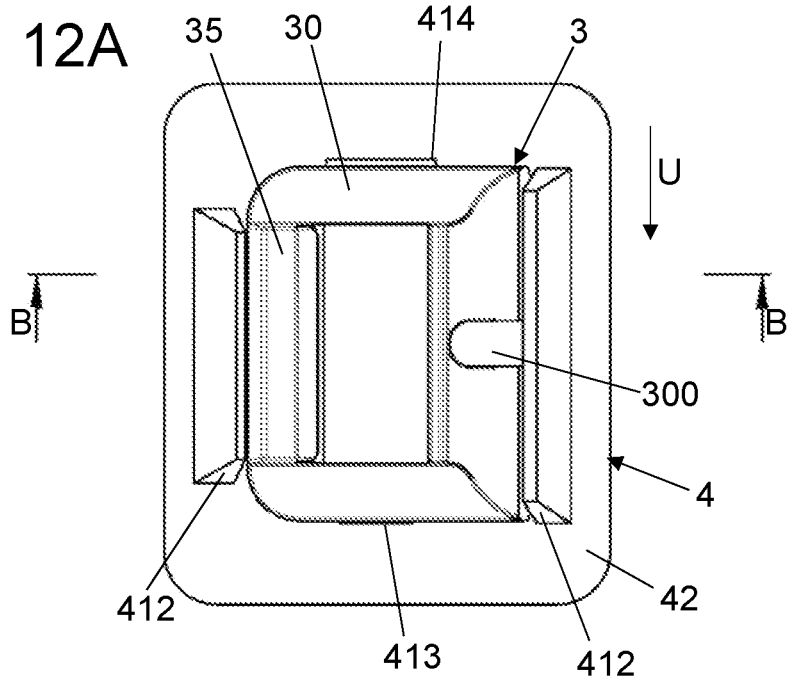
FIG. 12A shows a top view of the arrangement of FIG. 11.
Figure 12B:
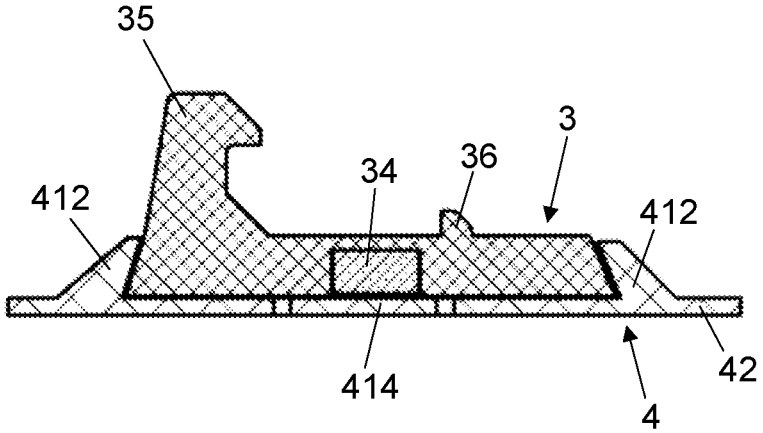
FIG. 12B shows a sectional view along line B-B of FIG. 12A.
Figure 13A:
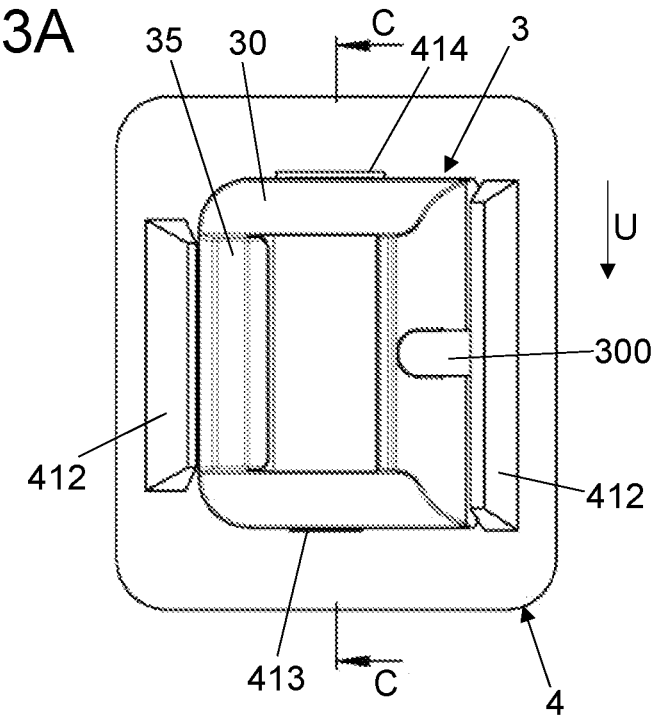
FIG. 13A shows the top view of FIG. 12A.
Figure 13B:
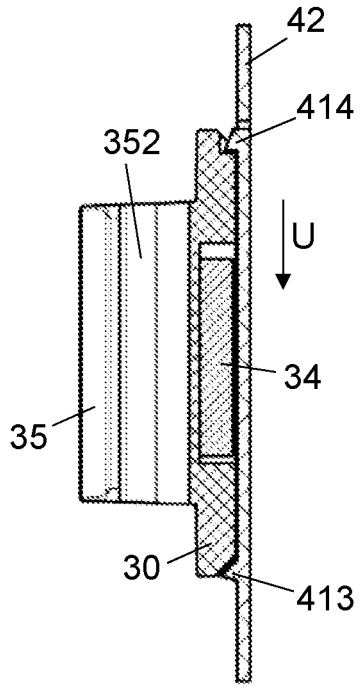
FIG. 13B shows a sectional view along line C-C of FIG. 13A.

The first closure part 2 and the second closure part 3 each include a magnetic element 24, 34, as can be taken from the sectional view of FIG. 9B.

Figure 7:
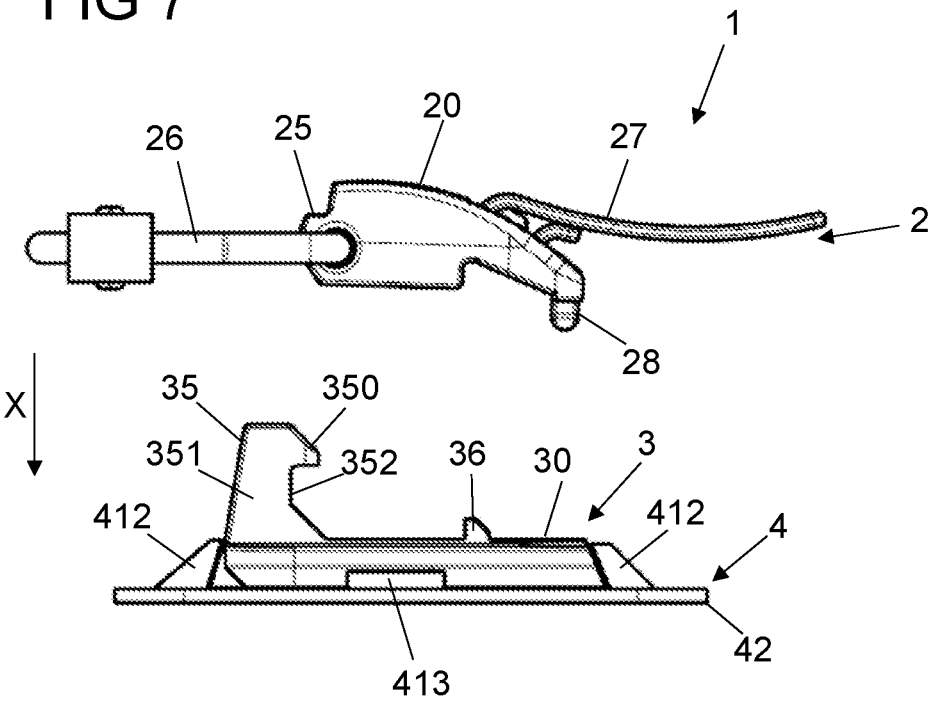
FIG. 7 shows a view of the closure device, when a first closure part is attached to a second closure part.
Figure 8:
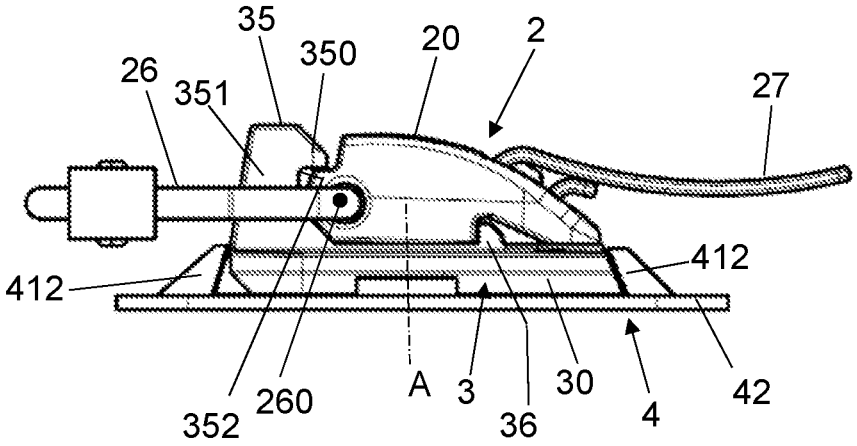
FIG. 8 shows a view of the closure device in a closed position.

For closing the closure device 1, the closure parts 2, 3 can be attached to each other along a closing direction X, as this is shown in the transition from FIG. 7 towards FIG. 8.

In a closed position of the closure device 1, the engagement element 25 of the first closure part 2 is in positive engagement with the engagement element 35 of the second closure part 3, wherein the engagement is secured by the blocking element 36 on the body 30 of the second closure part 3.

Due to the fact that the force introduction axis 260 is located between an abutment surface 352 on the engagement element 35, which the engagement element 25 faces in the closed position, and a perpendicular plane A pointing through the center of gravity of the magnetic element 34, a stable hold of the closure parts 2, 3 at each other is obtained in the closed position, in that in the closed position the closure parts 2, 3 are magnetically drawn towards each other by the magnetic elements 24, 34 and the engagement between the engagement elements 25, 35 also is secured by the blocking element 36.

In the closed position, a securing lug 28 on the body 20 of the first closure part 2 is in engagement with an associated securing opening 300 on the body 30 of the second closure part 3 so as to secure the transverse position of the closure parts 2, 3 relative to each other.

By pulling on the actuating element 27, a user can lift the first closure part 2 from the second closure part 3 and thereby eliminate the blockage by the blocking element 36. By pulling on the actuating element 27, the closure parts 2, 3 thus can be released from each other in a simple way.

In the illustrated exemplary embodiment, the connecting part 4 includes a fastening device 41 which is designed to produce a positive connection with the second closure part 3.

Figure 6:
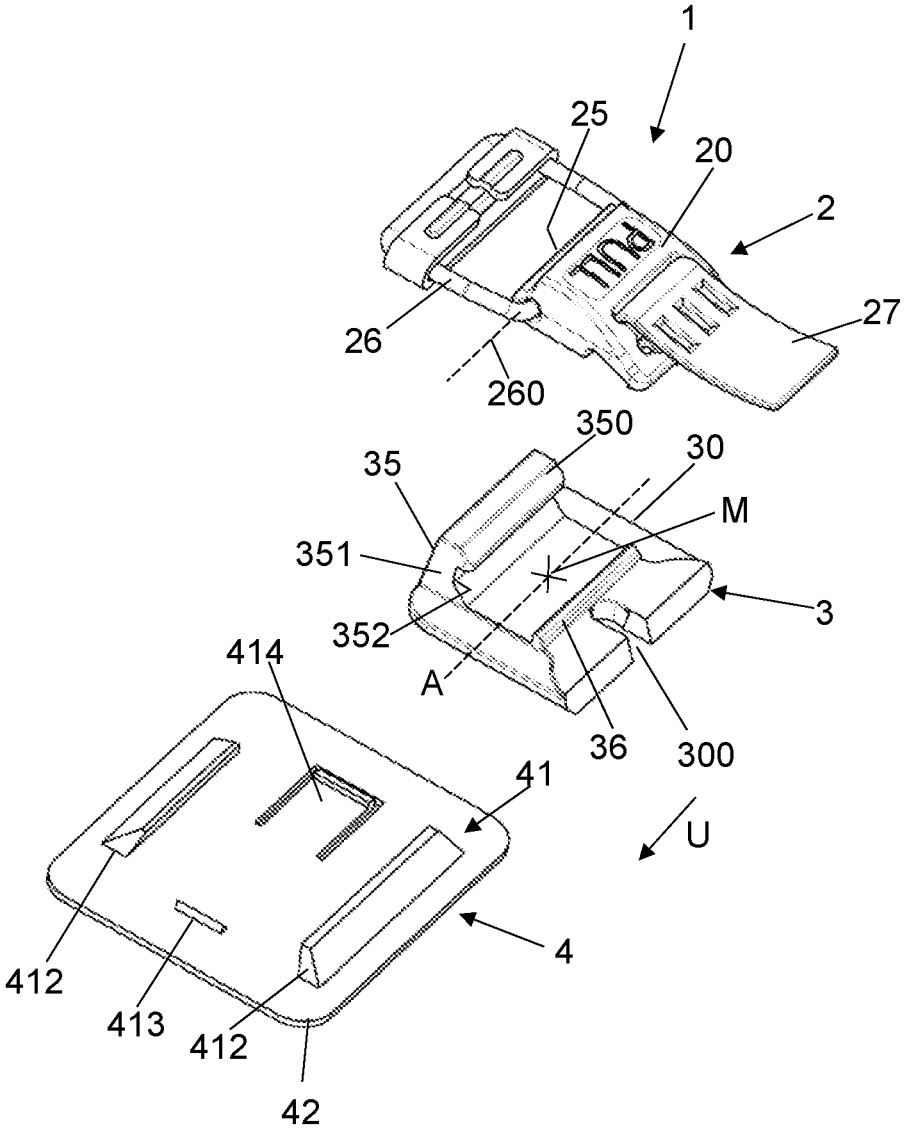
FIG. 6 shows a view of another exemplary embodiment of a closure device.

The fastening device 41 includes two form-fit elements 412 extended parallel to each other, between which the body 30 of the second closure part 3 can be pushed along a fastening direction U perpendicular to the closing direction X, as can be taken from FIG. 6 in a synopsis with FIGS. to 13A, 13B. In the fastened position, the body 30 rests between the form-fit elements 412 and is in contact with a stop element 413 via a front edge so that the body 30 takes a defined position between the form-fit elements 412 along the fastening direction U. The position of the body 30 relative to the connecting part 4 here is secured via a latching element 414 which is deflected on insertion of the body 30 and in the fastened position is in engagement with a rear edge of the body 30 so that the hold of the second closure part 3 on the connecting part 4 thereby is secured along the fastening direction U.

By releasing the latching of the latching element 414, the connection of the second closure part 3 can be released from the connecting part 4 by pushing the second closure part 3 out of engagement with the form-fit elements 412 against the fastening direction U.

The connection via the form-fit elements 412 in the fastened position can be such that in case of excessive load, for example when a breakaway force is applied to the second closure part 3, which exceeds a limit force, the second closure part 3 can get out of engagement with the form-fit elements 412 in a vertical direction. In this way, an emergency release can be provided in case of excessive load.

Figure 14:
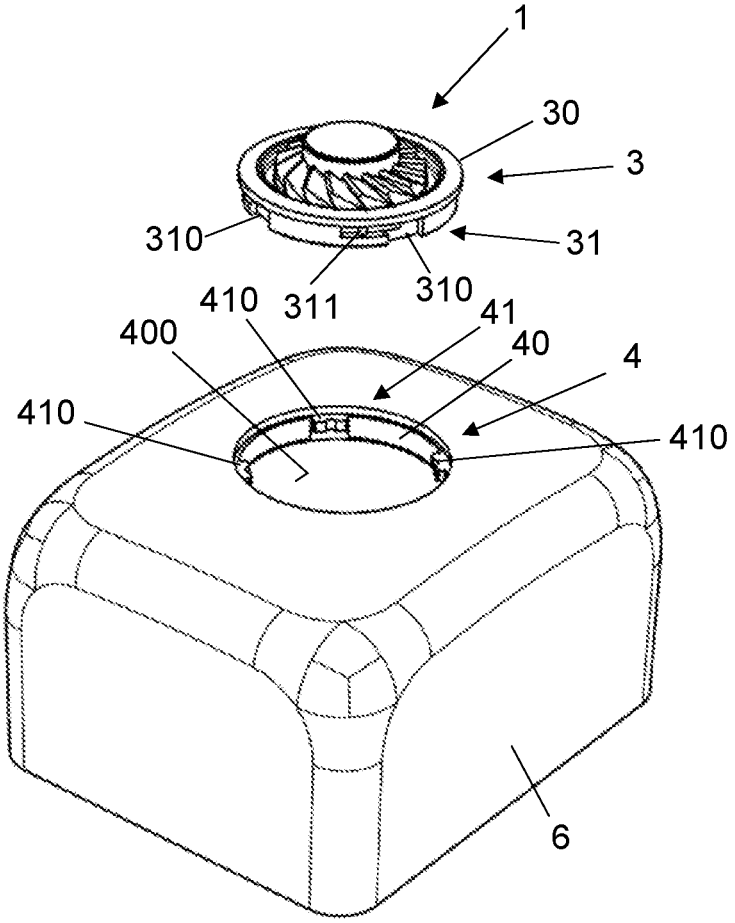
FIG. 14 shows a view of another exemplary embodiment of a closure device, representing a second closure part for fastening to an associated, second assembly.
Figure 15:
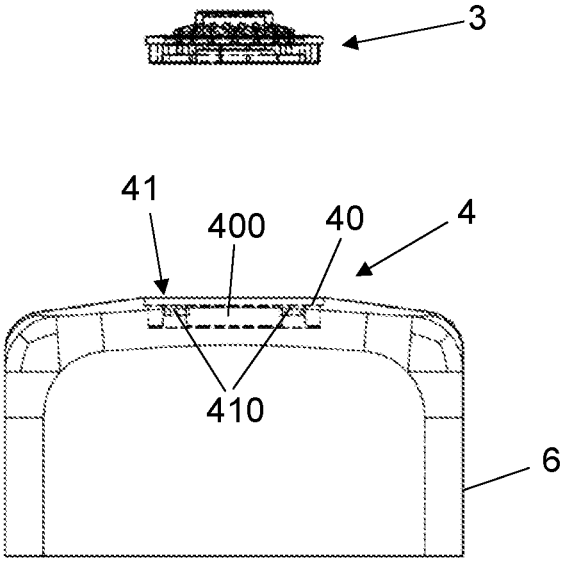
FIG. 15 shows a side view of the arrangement of FIG. 14.
Figure 16:
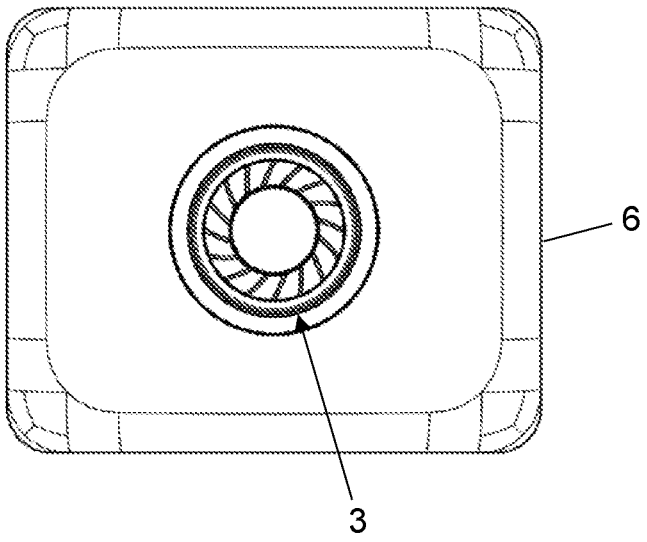
FIG. 16 shows a top view of the arrangement of FIG. 15.

In yet another exemplary embodiment, which is shown in FIGS. 14 to 16, a closure device 1 includes closure parts 2, 3, identically as described above with reference to the exemplary embodiment of FIGS. 1 to 5A-5C. The closure parts 2, 3 in the exemplary embodiments of FIGS. 14 to 16 and FIGS. 1 to 5A-5C are identical in functional and constructional terms, wherein the closure part 2 is not shown in FIGS. 14 to 16 for a simplified overview.

In contrast to the exemplary embodiment of FIGS. 1 to 5A-5C, a separate connecting part 4 is not provided in the exemplary embodiment of FIGS. 14 to 16, but a fastening device 41 is integrated into a housing part of an associated, second assembly 6 so that the second closure part 3 can directly be fastened to the second assembly 6 via the fastening device 41.

As has been described with reference to FIGS. 1 to 5A-5C, the fastening device 41 includes engagement elements 410 which are arranged within an opening 400 formed in the housing part of the assembly 6 and protrude inwardly into the opening 400. By insertion into the opening 400, the engagement elements 410 can be brought into engagement with the engagement openings 31 on the body 30 of the closure part 3 to produce a bayonet connection, in order to thereby produce a form fit between the engagement elements 410 and the body 30 of the closure part 3, as has been described above with reference to FIGS. 1 to 5A-5C.

In the exemplary embodiment of FIGS. 14 to 16, the closure part 3 thus is directly fixed to the associated, second assembly 6 via the bayonet connection. In so far, there is not provided a connecting part 4 separate from the second assembly 6, but the fastening device 41 is directly integrated into the second assembly 6, for example into a housing part of the second assembly 6.

In addition, reference is made to the explanations concerning the exemplary embodiment of FIGS. 1 to 5A-5C.

The idea underlying the invention is not limited to the exemplary embodiments described above, but can also be realized in a different way.

In the illustrated exemplary embodiment, the second closure part can be released from the connecting part, which provides for a maintenance, renewal or restoration of the second closure part due to the fact that the second closure part can be released from the connecting part and can be exchanged or repaired.

The releasable connection also provides for simple recycling in that the second closure part or at least parts of the second closure part, for example the magnetic element of the second closure part, can be reused.

The connecting part can be manufactured easily and at low cost and can also be adapted to the associated assembly.

Due to the fact that the second closure part is not directly fixed to the associated assembly, but indirectly via the connecting part, an integration of the closure device is possible also into assemblies in which a direct attachment of the second closure part to an associated assembly is not easily possible.

The connecting part for example can be fabricated jointly with the associated assembly, in that the connecting part is fixed to the assembly during manufacture or possibly is also fabricated integrally with the second assembly. The second closure part is fixed to the connecting part only subsequently, so that an impairment of the second closure part, for example by action of heat on the magnetic element of the second closure part, is avoided during the manufacture of the assembly.

LIST OF REFERENCE NUMERALS

1 closure device
2 closure part
20 body
21 handle element
22 winding portion
23 toothing portion
24 magnetic element
25 engagement element
26 force introduction element
260 force introduction axis
27 actuating element
28 securing lug
3 closure part
30 body
300 securing opening
301 receiving opening
31 engagement opening
310 fitting portion
311 locking portion
312 arresting element
32 pin
33 toothing portion
34 magnetic element
35 engagement element
350 arresting portion (undercut)
351 rigid portion
352 abutment surface
4 connecting part
40 shell surface
400 opening
41 fastening device
410 engagement element
411 arresting opening
412 form-fit elements
413 stop element
414 latching element
42 integration portion
5, 6 assembly
A axis
D axis of rotation
M center
X closing direction
U fastening direction

The invention claimed is:

1. A closure device for connecting two assemblies to each other, comprising a first closure part, which is associated to a first one of the assemblies and includes a first magnetic element, and a second closure part, which includes a second magnetic element, wherein the first closure part and the second closure part can be attached to each other along a closing direction by magnetic attraction between the first magnetic element and the second magnetic element, are mechanically and/or magnetically held at each other in a closed position, and can be separated from each other for opening the closure device, wherein a connecting part, which includes a fastening device for fastening the second closure part to the connecting part and an integration portion for fixing the connecting part to a second one of the assemblies, wherein the fastening device is configured to produce a bayonet connection with the second closure part, wherein the fastening device includes an opening into which the second closure part can be inserted for fastening to the connecting part, and in which the second closure part can be rotated about an axis of rotation to produce the bayonet connection, wherein the fastening device includes at least one engagement element protruding into the opening to produce the bayonet connection with the second closure part, and wherein the fastening device includes a shell surface extended around the opening, on which the at least one engagement element is arranged.

2. The closure device according to claim 1, wherein the integration portion is configured for sewing, welding or gluing to the second one of the assemblies.

3. The closure device according to claim 1, wherein the second closure part can be fastened to the connecting part when the connecting part is connected to the second one of the assemblies.

4. The closure device according to claim 1, wherein the fastening device is configured to produce a positive and/or non-positive connection with the second closure part.

5. The closure device according to claim 1, wherein the second closure part includes at least one engagement opening in which the at least one engagement element engages with the bayonet connection made.

6. The closure device according to claim 1, wherein the second closure part has a body and a receiving opening arranged in the body for receiving the second magnetic element, wherein the receiving opening is closed by the connecting part in a position of the second closure part fastened to the connecting part.

7. An arrangement, comprising a closure device for connecting two assemblies to each other, the closure device comprising a first closure part, which is associated to a first one of the assemblies and includes a first magnetic element, and a second closure part, which includes a second magnetic element, wherein the first closure part and the second closure part can be attached to each other along a closing direction by magnetic attraction between the first magnetic element and the second magnetic element, are mechanically and/or magnetically held at each other in a closed position, and can be separated from each other for opening the closure device, and wherein a connecting part, which includes a fastening device for fastening the second closure part to the connecting part and an integration portion for fixing the connecting part to a second one of the assemblies, wherein the first closure part is connected to the first one of the assemblies and the integration portion is sewn, welded or glued to the second one of the assemblies, and wherein the arrangement is a textile arrangement or wherein the arrangement is a shoe, a garment, a bag, a backpack or a suitcase.

8. A closure device for connecting two assemblies to each other, comprising a first closure part, which is associated to a first one of the assemblies and includes a first magnetic element, and a second closure part, which is associated to a second one of the assemblies and includes a second magnetic element, wherein the first closure part and the second closure part can be attached to each other along a closing direction by magnetic attraction between the first magnetic element and the second magnetic element, are mechanically and/or magnetically held at each other in a closed position, and can be separated from each other for opening the closure device, wherein a fastening device for fastening the second closure part to the second one of the assemblies, wherein the fastening device is configured to produce a bayonet connection with the second closure part, wherein the fastening device includes an opening into which the second closure part can be inserted for fastening to a connecting part, and in which the second closure part can be rotated about an axis of rotation to produce the bayonet connection, wherein the fastening device includes at least one engagement element protruding into the opening to produce the bayonet connection with the second closure part, and wherein the fastening device forms a shell surface extended around the opening, on which the at least one engagement element is arranged.

9. The closure device according to claim 8, wherein the second closure part includes at least one engagement opening in which the at least one engagement element engages with the bayonet connection made.

* * * * *